US005673762A

United States Patent [19]

Pennington

[11] Patent Number: 5,673,762

[45] Date of Patent: Oct. 7, 1997

[54] EXPENDABLE PROTECTIVE SLEEVE AND METHOD OF USE FOR SOIL AND GROUNDWATER SAMPLING

[76] Inventor: Leslie Howard Pennington, 852 E. Windsor La., Bountiful, Utah 84010

[21] Appl. No.: 580,629

[22] Filed: Dec. 29, 1995

[51] Int. Cl.[6] ..... E21B 49/02

[52] U.S. Cl. ..... 175/20; 175/58

[58] Field of Search ..... 175/20, 58, 246, 175/249

[56] References Cited

U.S. PATENT DOCUMENTS

| | | | |
|---|---|---|---|
| 3,047,081 | 7/1962 | Pitcher | 175/20 X |
| 3,075,588 | 1/1963 | Mitchell | 175/20 |
| 4,518,050 | 5/1985 | Sollie et al. | 175/58 X |
| 5,186,263 | 2/1993 | Kejr et al. | 175/20 |

OTHER PUBLICATIONS

Hurricane Dual Sampling System—Universal Environmental Engineering—Brochure date unknown.

CBC (Christensen Boyles Corporation—Auger & Soil Tools—catalog date unknown.

*Primary Examiner*—William P. Neuder

*Attorney, Agent, or Firm*—Thorpe North & Western, LLP

[57] ABSTRACT

A method for obtaining saturated soil samples includes conventional drilling equipment with a central hollow which receives a conventional soil sample collection device. An elongate sleeve with a closed end is nested about the sample collection device to prevent soil from entering the sample device before it is in position adjacent the soil to be sampled. Once in position, force is applied to the sample collection device to drive it into the soil. As the sample collection device is driven into the soil, it penetrates through the sleeve. The sample collection device is then withdrawn, leaving the sleeve in the hole formed by the collection device to help prevent collapse of the walls. The sleeve also helps to minimize any negative pressures which might develop as the sample collection device is withdrawn and which can result in soil plugging the central hollow of the auger.

26 Claims, 5 Drawing Sheets

EXPENDABLE PROTECTIVE SLEEVE AND METHOD OF USE FOR SOIL AND GROUNDWATER SAMPLING

BACKGROUND OF THE INVENTION

1. Field of the Invention

The present invention relates to an apparatus and method for use with soil/groundwater sampling equipment, and in particular, to an expendable protective sleeve and method for use to keep soil samplers and bore casings free from debris and other undesirable materials, and to prevent the development of negative pore pressure upon removal of the sampling device.

2. Background Art

It has become common to obtain groundwater and soil samples from various locations. The soil samples may be used to determine if an area is suitable for construction of buildings, roadways, etc. Soil and groundwater samples my be used to determine if groundwater and/or soil contamination may be present.

When analyzing an area, it is important to collect soil and groundwater samples which have not been disturbed or tainted. The collection of undisturbed soil samples is prerequisite for proper engineering analysis of samples which have not been cross-contaminated from overlying strata subsurface contamination.

When taking soil and groundwater samples, it is common to use an auger which bores a hole into the earth. As the auger is moved downwardly, samples may be taken for analysis to determine soil characteristics and in what zones contamination may be present. To facilitate such sampling, it is common to use an auger with a hollow cylindrical center which can be used to carry a sampling device.

During the collection of soil and groundwater samples from the various types of bore holes, saturated soils commonly invade the bore hole or the bore hole casing causing delays in the boring operation and then uncertainty as to the validity of the data attained from the sampling process. Those skilled in the art will appreciate that a disturbed or tainted sample is of little use. Thus, a variety of techniques have been used to prevent this phenomenon.

One common technique includes placing water within the bore hole to overcome external hydrostatic pressure. In collecting environmental samples, however, the placement of clean water into the bore hole can render the test results suspect and is often not practical. First, the water may dilute or spread the contaminants for which the sample is being taken, thereby giving an artificially low contamination reading when the soil is analyzed. Second, when drilling in very permeable or sandy soil, additional water must be added frequently to prevent the soil from entering into the auger. The large quantities of water raise the dilution concerns discussed above. In remote locations the requirement of additional water is often also impractical or sometimes impossible, as there is often not a convenient source of water which is known to be pure. Obviously, pumping water from a stream or other natural water source is not desirable, as the water itself may be contaminated, thereby increasing the chance of inaccurate results.

Another technique involves suspending a metal plug from a drill rod that is advanced concurrently with the auger in the bore hole. When the desired depth is obtained, the plug is removed from the auger to allow soil or groundwater sampling. Unfortunately, when the metal plug is removed from the auger, negative pressure is often developed. This is especially true in saturated soils. The negative pressures draws groundwater, sand and other debris into the bore hole plugging the auger and preventing sampling until the auger has been unplugged.

In an attempt to overcome this concern, yet another technique to inhibit the invasion of soil and groundwater into the sample collection device prior to reaching the desired sampling depth involves the placement of tape over the open end of the sample collection device. This technique tends to inhibit the invasion of soil and groundwater into the sample collection device. However, the technique does not inhibit the development of a negative pressure when the sampler is removed from the bore hole, thus allowing groundwater, sand, or other contaminants to be draw into the auger and thereby potentially taint any further samples.

Thus there is a need for an apparatus and method for preventing soils and water from being drawn into a hollow auger thereby plugging the auger. Such an apparatus should be inexpensive to use and expendable. Such an apparatus should also not interfere with subsequent drilling/sampling.

SUMMARY OF THE INVENTION

It is an object of the invention to provide an apparatus and method for inhibiting sand and other debris from plugging the bore hole and auger during the collection of soil and groundwater samples.

It is another object of the present invention to provide an apparatus and method which inhibits the collapsing of bore hole sidewalls below the leading edge of the auger during collection of soil and groundwater samples.

It is an additional object of the present invention to provide an apparatus and method which increases the speed of the sample collection process.

It is yet another object of the present invention to facilitate the collection process by allowing suspension of the sample collection device in the bore hole during advancement of the auger until a desired sampling depth is obtained without allowing the bore hole to be contaminated by unwanted debris.

It is an additional object of the present invention to prevent the invasion of contaminated soil and groundwater into the sample collection device as the collection device is lowered to the desired sampling depth.

It is yet another object of the present invention to provide such an apparatus and method which is inexpensive and easy to use.

These and other objects and advantages will be apparent from the present invention wherein an expendable protective sleeve is disposed within the auger forming the bore hole so as to cover the sample collection device and inhibit the flow of sand, soil or groundwater between the auger and sample collection device. The sleeve comprises an elongate portion typically formed in the shape of a cylinder having first and second ends. The first end is closed by a solid covering member, while the second end remains open.

In use the sleeve is slid onto the lower end of a sample collection device by placing the collection device in the open second end of the sleeve and moving the collection device downwardly, adjacent to the first, closed end of the sleeve. The soil sample collection device may then be placed in the auger with the open end disposed at the bottom.

In accordance of one aspect of the invention the sleeve is made of a water resistant, yet destructible material such as polyethylene or polypropylene. When the sampling device is ready to be used, is pushed or driven so that its lower end penetrates through the solid covering member in the first end of the sleeve and into contact with the soil or groundwater at the desired sampling depth. The sampling device may then be withdrawn and the undisturbed soil or groundwater contained therein analyzed for soil characteristics or pollutants.

In addition to preventing soil from entering into the sample collection device while prior to positioning at the desired depth, and preventing soil or groundwater from entering between the sample collection device and the auger, the sleeve also helps to prevent a negative pressure from forming within the bore hole when the sampling device is withdrawn. With traditional drilling equipment, the withdrawal of the sample collection device was often accompanied by a negative pressure (suction) which caused the bore hole to collapse and cause soil and groundwater to enter and plug into the central bore of the auger. The soil in such a position prevents the collection of additional soil samples.

The sleeve, by remaining in place while the sample collection device is withdrawn, lessens the likelihood that a negative pressure will develop. The sleeve also helps resist any collapse of the bore hole below the leading edge of the auger.

If samples at different depths are desired, the first sample will be taken as indicated above. The auger will then be advanced down to a position just above the site of the next sample with a second sample collection device and sleeve mounted thereabout. As the auger drills further into the soil, the sleeve of the first sample holder is destroyed. Thus, it is beneficial to form the sleeve from a material which will not contaminate either the soil or the groundwater which is being tested.

In accordance with the principals of the present invention, the method of using the sleeve includes sliding the sleeve onto the sample collection device and positioning the collection device so that the sleeve is disposed between the collection device and the auger. In such a position, the sleeve prevents groundwater and soil from extending upwardly therein. Once the sample collection device and sleeve are disposed within the auger, drilling may begin. At the desired depth, the sample collection device is pushed through the sleeve and the sample obtained. The sample collection device is then removed. The auger is then withdrawn, or the auger is advanced to additional testing positions and a sample collection device with a sleeve moved into position to take another sample.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figure 1:
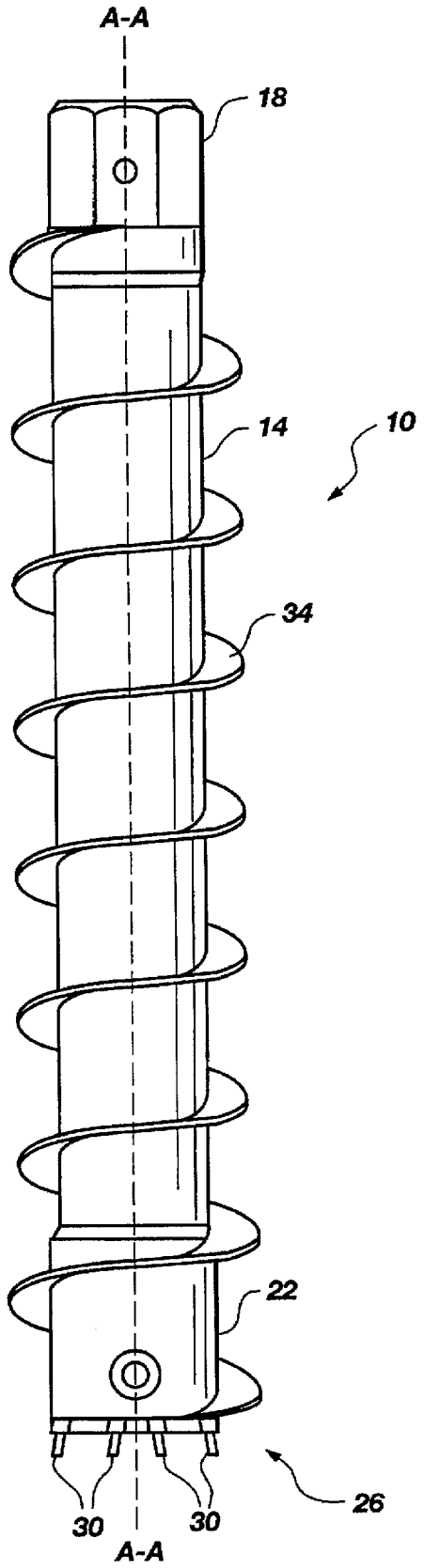
Fig. 1 (PRIOR ART)
FIG. 1 shows a perspective view of a auger casing which is made in accordance with the teachings of the prior art.

Referring to FIG. 1, there is shown a perspective view of a hollow-stem auger, generally indicated at 10. The auger 10 includes an elongate, cylindrical central shaft 14 defining a hollow portion (not shown). The cylindrical shaft 14 has an upper end 18 which attaches to a drilling shaft (not shown) so that the drilling shaft rotates the auger 10 as the drilling shaft rotates.

At an opposite end of the auger 10 is a receptacle 22 for receiving a cutter head, such as that generally indicated at 26. As the auger 10 rotates about its long axis A—A, the cutter head 26 cuts through the soil. As shown in FIG. 1, the cutter head 26 is the type commonly referred to as a finger type. The cutter head 26 gets its name from the elongate fingers 30 which extend downwardly and cut through the soil. Those skilled in the art will appreciate that there are several other types of cutter heads which may be used.

Disposed about the central shaft 14 of the auger 10 is a flighting 34 which lifts cut soil out of the bore hole formed by the auger. Thus, the flighting 34 helps to prevent the auger 10 from getting clogged with cut soil.

Figure 2:
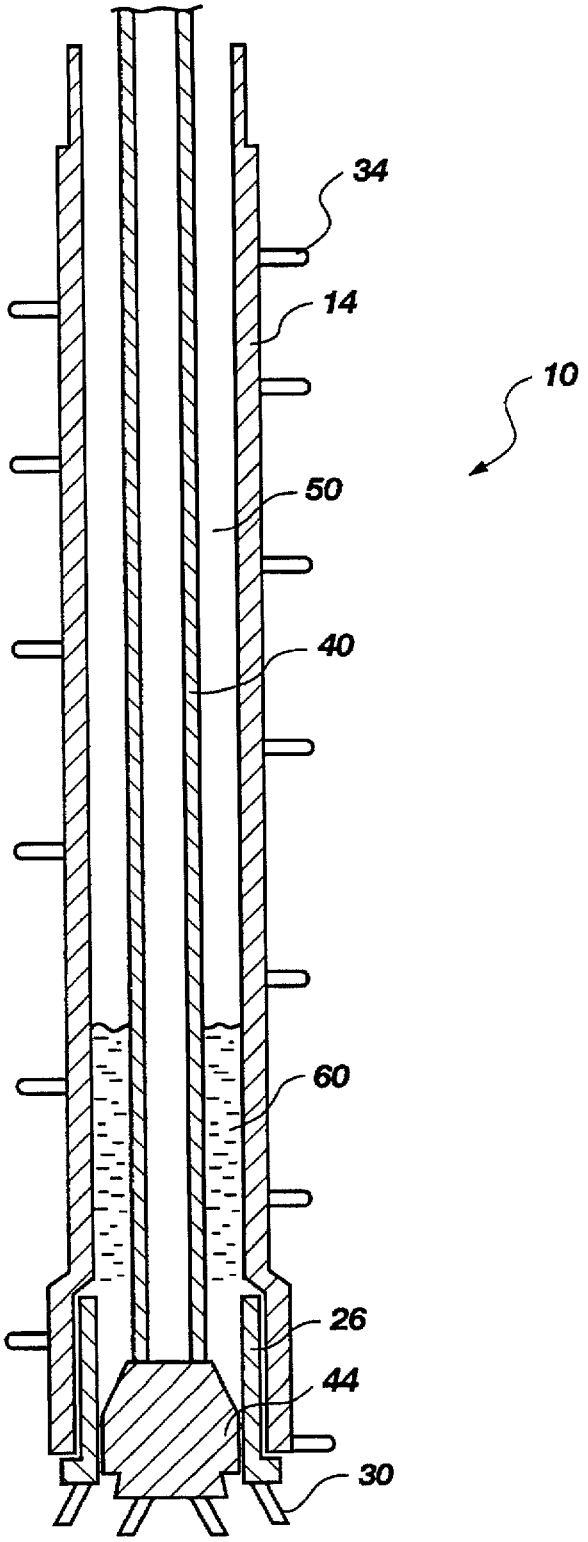
Fig. 2 (PRIOR ART)
FIG. 2 shows a cross-sectional view of an auger with a rod and bit disposed therein in accordance with the teachings of the prior art.

Referring now to FIG. 2, there is shown a cross-sectional view of the auger 10 and a rod 40 and bit 44 disposed therein. As the auger 10 rotates, the rod 40 and bit 44 are rotated in like directions to penetrate the soil. The bit 44 also helps to prevent the flow of fluids into the central hollow 50 where it may contaminate soil or groundwater samples to be taken further down in the bore hole.

When the appropriate depth has been reached within the soil, the rod 40 and bit 44 are removed from the central hollow 50 of the auger 10 to allow a soil/groundwater sample collection device (not shown) to be passed down through the central hollow 50 and into contact with the soil or groundwater to be sampled. Unfortunately, the withdrawal of the bit 44 often creates a negative pressure (suction) within the central hollow 50 of the auger 10. This is especially true when the auger 10 extends into soil which is below groundwater. Adhesion of the saturated soil creates an effective seal such that withdrawal of the bit creates suction.

The negative pressure within the central hollow 50 draws soil and water upwardly as represented by the shaded area 60. Once the water or soil has entered the auger 10, it must be removed. If it is not, subsequent soil and groundwater samples may not be reliable, as the sampling container will first be filled with the water or soil drawn in, rather than the undisturbed soil below the auger 10.

Figure 3:
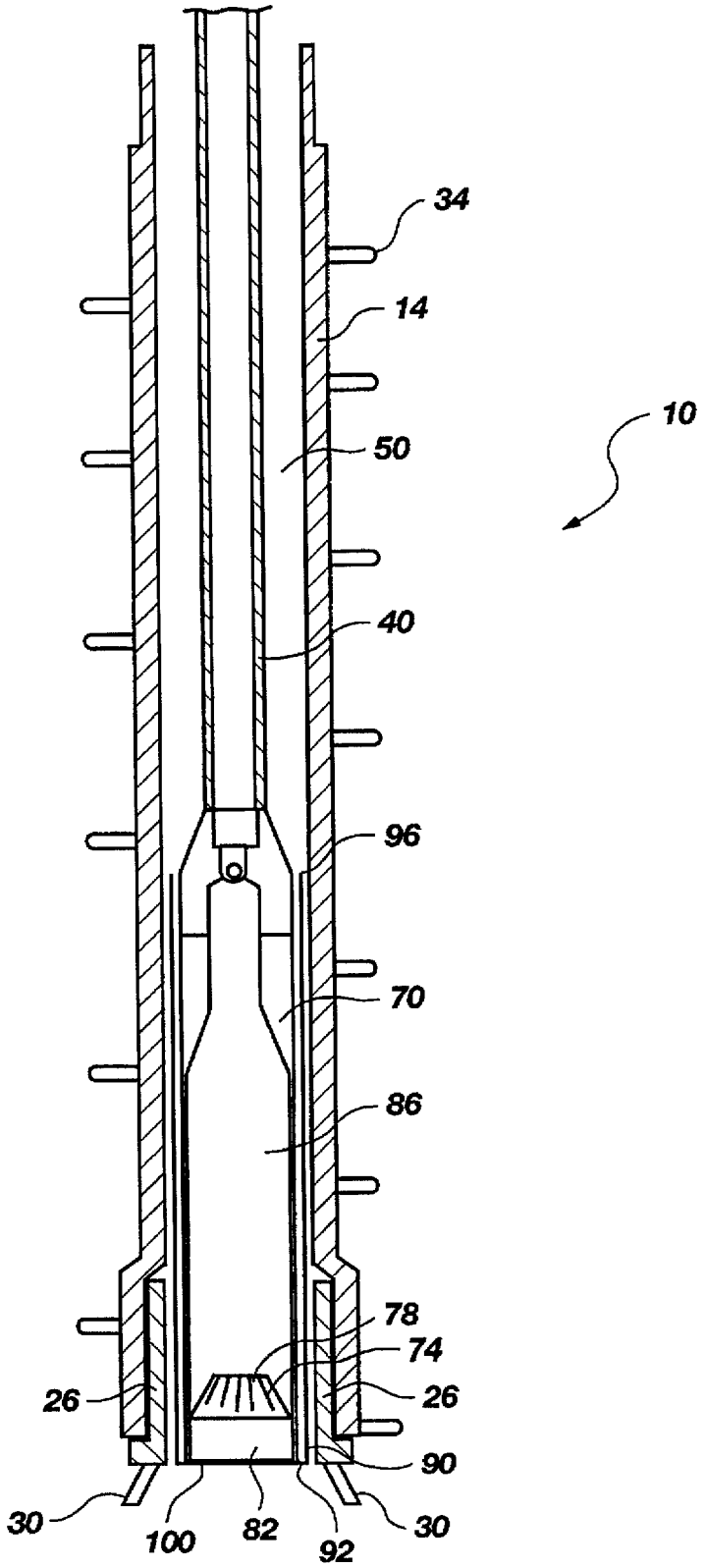
FIG. 3 shows a cross-sectional view of the prior art auger of FIG. 1, with a prior art sample collection device and the sleeve of the present invention.

Referring now to FIG. 3, there is shown cross-sectional view of the prior art auger 10 of FIGS. 1 and 2. The auger includes the central shaft 14 with a flighting 34 disposed thereabout. Disposed in the central hollow 50 of the central shaft 14 is the rod 40 and a soil sample collection device 70. Those skilled in the art will appreciate that there are numerous different types of soil sample and groundwater collection devices 70. For example, FIG. 3 shows a collection device 70 which has a hemispherical spring 74 having a plurality of cuts formed therein so that a plurality of fingers 78 formed thereby can deflect out of the way as a soil sample (not shown) enters the soil sample collection device 70 from an open lower end 82. Once the soil sample has passed the hemispherical spring 74 and into a holding portion 86, the fingers 78 return to their original position and prevent the soil sample from falling out. Other common types of soil sample collection device include trap valve type and other similar arrangements.

Those skilled in the art will appreciate that the major problem with such sample collection devices 70 is the risk that soil will begin to accumulate in the holding portion 86 of the device as the auger 10 is driven downwardly. For this reason, those operating the equipment generally have avoided placing the collection device 70 into the auger 10 until the auger is disposed above the desired location. The collection device 70 is then forced downwardly by the rod 40 into the undisturbed soil below the auger 10.

In accordance with the principles of the present invention, it has been found that the auger 10 can be operated with the soil sample collection device 70 in place without collecting unwanted soil by using a protective sleeve 90. The sleeve 90 has first and second ends, 92 and 96 respectively, the first end being closed by a covering member 100. The second end 92 is open so that the soil sample collection device 70 can be slid into the sleeve 90.

When the protective sleeve 90 is nested about the soil sample collection device 70 soil is not able to work its way up into the collection device. By removing this risk, the samples taken with the collection device 70 are generally more reliable. Additionally, the sleeve 90 adds little extra work other than the few seconds necessary to place it about the collection device 70.

Figure 3A:
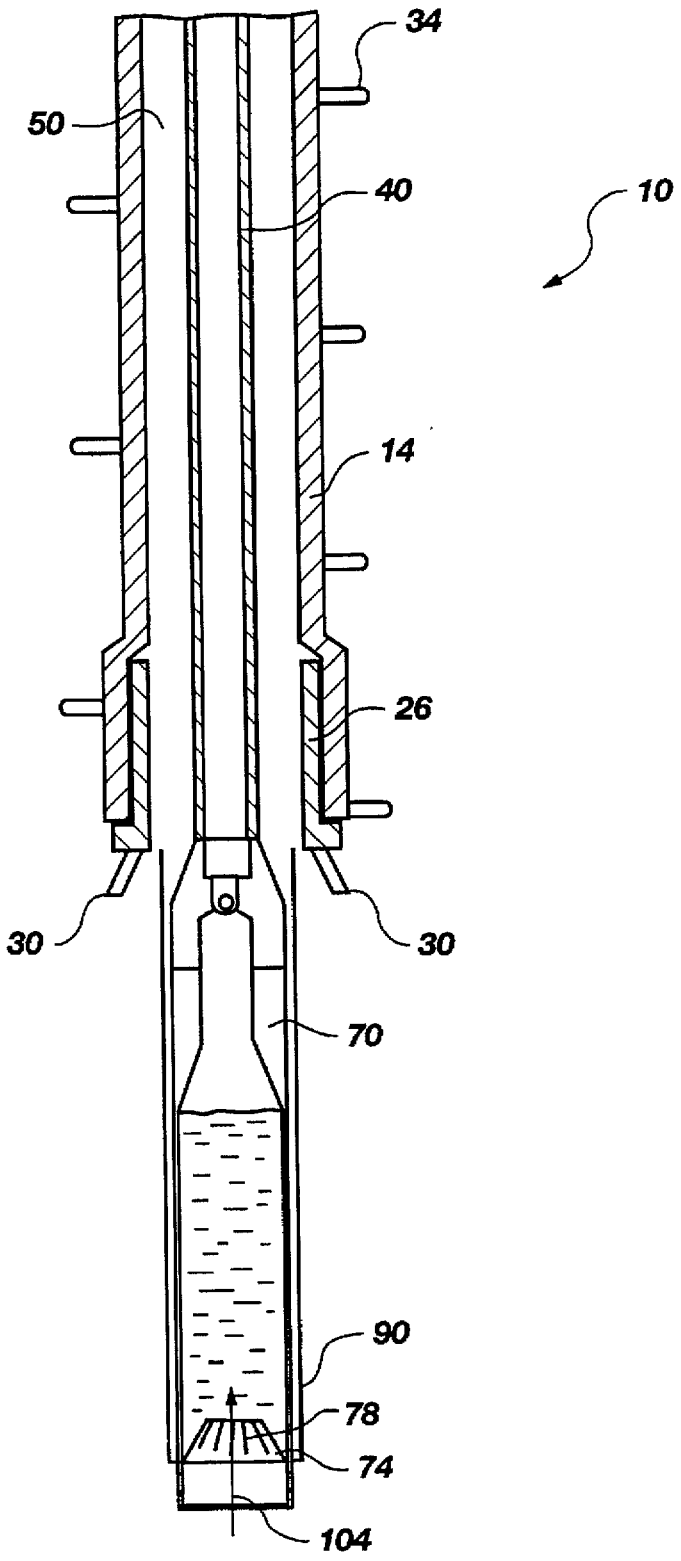
FIG. 3A shows a cross-sectional view of the auger of FIG. 3, with the sample collection device and protective sleeve extending down into the soil into a position common to soil sampling techniques.

Referring now to FIG. 3A, there is shown a fragmented cross-sectional view of the invention as shown in FIG. 3, but with the soil sample collection device 70 deployed in a collecting position. Because it is important to obtain undisturbed soil samples, it is necessary to extend the soil sampling collection device 70 below the end of the auger 10. This is usually accomplished by applying a downward force with the rod 40 which is sufficient to drive the soil sample collection device 70 to penetrate the soil. Those skilled in the art will recognize that there are specific standards for the amount of force used and the number of impacts made when driving the device 70 into the ground.

As the soil sample collection device 70 is driven into the ground, the force causes it to puncture the covering member 100 at the first end 92 of the sleeve 90. Once the lower end 82 of the collection device 70 punctures the covering member 100, soil can freely move through the lower end and into the holding portion 86 as indicated by the arrow 104.

Once the soil sample collection device 70 has been driven to the desired depth, the device can be withdrawn from the bore hole and the sample removed. Another soil sampling device, with a sleeve disposed thereon, may then be moved down the central hollow 50 of the auger 10 and adjacent the cutter head 26.

Typically, the sleeve 90 will remain in the hole formed by the soil sample collection device 70. In such a position, the sleeve 90 serves several important functions. One of the major problems with such sampling devices is that they create a negative pressure as they are withdrawn from the soil. The negative pressure can cause the walls of the bore hole to collapse, and can even result in soil or water being drawn up into the auger 10. The sleeve 90, however, minimizes the risk of a negative pressure being developed. The sleeve also inhibits the ability of the walls of the bore hole to collapse as the sample collection device 70 is withdrawn, further reducing the potential of soil plugging the auger.

Once the sample collection device 70 is withdrawn and replaced (when additional sampling is desired), the auger 10 will generally shred the sleeve 90 as it advances down to the position of the next sample. Thus, the second or replacement sample collection device will have its own sleeve.

Figure 4:
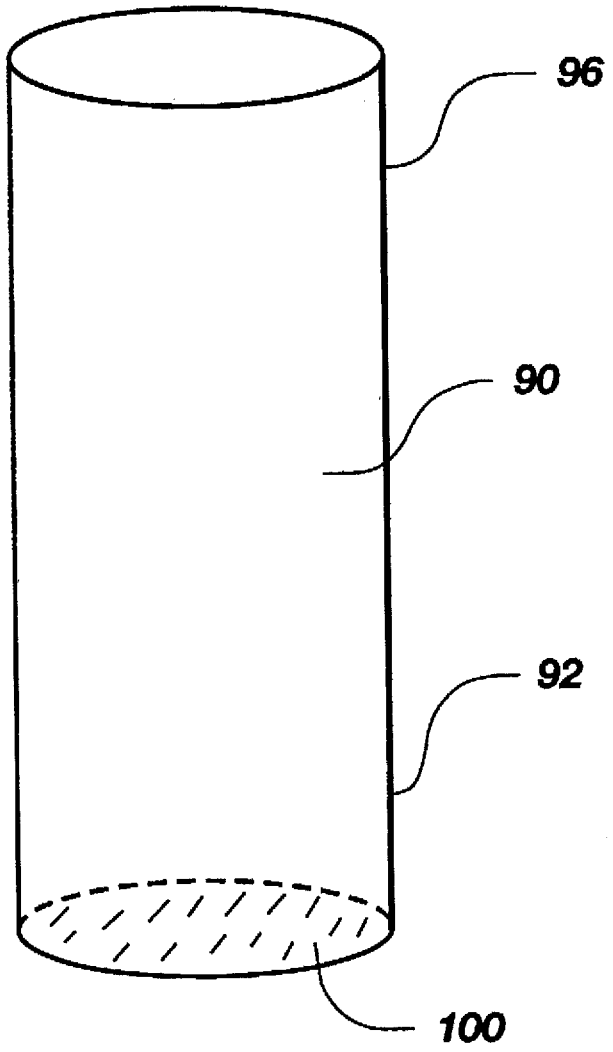
FIG. 4 shows a perspective view of an expendable protective sleeve for soil samples made in accordance with the teachings of the present invention.

Referring now to FIG. 4, there is shown a perspective view of a sampling sleeve made in accordance with the principles of the present invention. The sleeve 90 includes the first end 92 which is closed by the cover member 100, and the open second end 96 for sliding about the soil sample or groundwater sample collection device shown in FIGS. 3 and 3A. To receive the soil sample collection device, the inner diameter of the sleeve 90 must be slightly larger than the outer diameter of the collection device. It is preferred that the fit of the sleeve 90 about the collection device be relatively snug to prevent water from collecting between the sleeve and the collection device, but not so tight that the sleeve 90 will cling to the collection device as it is withdrawn through the auger and up the bore hole.

Because the sleeve 90 must resist the tendency of soils to enter into the collection device, the sleeve should be made of a durable material. While polyethylene and polypropylene have been mentioned, many other durable materials could also be used. Additionally, because the soil sampling collection devices often pass through water saturated soils, the sleeve 90 is preferably made with water resistant or waterproof materials. Those skilled in the art will be familiar with many different materials and will be able to identify advantages and disadvantages to each in light of the present disclosure.

Thus there is disclosed an expendable protective sleeve and a method for using the same for soil and groundwater sampling. Those skilled in the art will recognize numerous modifications which can be made without departing from the scope and spirit of the present invention. The appended claims are intended to cover such modifications.

What is claimed is:

1. A method for obtaining soil and groundwater samples, the method comprising:

a) drilling into soil with an auger having a central hollow extending longitudinally through the auger;

b) positioning a sample collection device in the central hollow of the auger, the sample collection device having an open bottom end for receiving samples; and c) covering the bottom end of the sample collection device with a protective sleeve means to prevent soil and water from entering the open bottom end while the collection device is disposed within the auger.

2. The method for obtaining soil samples of claim 1, wherein step a) comprises, more specifically, drilling into soil with the auger while the sample collection device is disposed within the central hollow of the auger.

3. The method for obtaining soil samples of claim 2, wherein the protective cover means is disposed about the sample collection device prior to positioning of the sample collection device within the central hollow of the auger.

4. A method for obtaining soil and groundwater samples, the method comprising:

a) drilling into soil with an auger having a central hollow extending longitudinally through the auger;

b) positioning a sample collection device in the central hollow of the auger, the sample collection device having an open bottom end for receiving samples; and c) covering the bottom end of the sample collection device with a protective sleeve means to prevent soil and water from entering the open bottom end while the collection device is disposed within the auger by providing an elongate sleeve for fitting over at least a portion of the sample collection device, the sleeve having an open end for sliding over the sample collection device and a closed end positionable adjacent the open bottom end.

5. The method for obtaining soil samples of claim 4, wherein the elongate sleeve is water resistant material.

6. The method for obtaining soil samples of claim 4, wherein the method includes forming the elongate sleeve from polypropylene.

7. The method for obtaining soil samples of claim 4, wherein the method includes forming elongate sleeve from polyethylene.

8. The method for obtaining soil samples of claim 4, wherein the auger has a lower end, and wherein the method further comprises forcing the sample collection device into soil below the auger.

9. The method for obtaining soil samples of claim 8, wherein the method comprises, more specifically, applying sufficient force to the sample collection device to cause the sample collection device to penetrate through the covering means of the sleeve.

10. The method for obtaining soil samples of claim 9, wherein the method further comprises withdrawing the sample collection device from the auger and leaving the sleeve in the soil at least partially below the auger.

11. The method for obtaining soil samples of claim 10, further comprising:

d) positioning a second sample collection device in the central hollow of the auger, the sample collection device having an open bottom end for receiving samples and an elongate sleeve disposed over the open bottom end so as to limit flow of soil and water into the open bottom end; and e) drilling into the soil to a depth below the sleeve in the soil;

f) applying force to the second sample collection device to drive the sample collection device into soil below the auger.

12. The method of claim 11, wherein the method further comprises causing the sample collection device to penetrate through the elongate sleeve and into contact with the soil disposed below the auger.

13. The method of claim 12, wherein the method further comprises withdrawing the sample collection device so that the elongate sleeve remains at least partially in the soil below the auger.

14. A method for obtaining soil and groundwater samples, the method comprising:

a) drilling into soil with an auger having a central hollow extending longitudinally through the auger;

b) positioning a sample collection device in the central hollow of the auger, the sample collection device having an open bottom end for receiving samples;

c) covering the bottom end of the sample collection device with a protective sleeve means to prevent soil and water from entering the open bottom end while the collection device is disposed within the auger with a sleeve having a first end with a closed cover member and an open second end disposed opposite the first end, and d) nesting the sample collection device within the sleeve so that the cover member is positioned adjacent to the open end of the sample collection device to prevent flow of soil and water into the sample collection device.

15. A method for obtaining soil samples, the method comprising:

a) providing a soil penetration mechanism having a central hollow with an open lower end disposed therethrough for obtaining samples;

b) positioning a sample collection device within the central hollow adjacent to the open lower end, the sample collection device having an open end for receiving a sample and a protective cover disposed thereabout with a closed end for preventing the flow of soil and water into the sample collection device;

c) operating the soil penetration mechanism to dispose the sample collection device adjacent soil to be sampled;

d) applying force to the sample collection device to drive the sample collection device through the protective cover and into soil below the soil penetration mechanism so that soil moves into the sample collection device; and (e) withdrawing the sample collection device and leaving the protective cover below the auger to prevent entry of contaminants into the hollow of the auger during withdrawal of the collection device.

16. The method of claim 15, wherein the method further comprises forcing the protective cover at least partially into the soil below the soil penetration mechanism with the sample collection device and withdrawing the sample collection device such that the protective cover remains at least partially within the soil.

17. The method of claim 16, further comprising drilling into the soil to a depth lower than the protective cover within the soil and positioning a second sample collection device with a second protective cover within the lower end of the hollow.

18. The method of claim 17, wherein the method further comprises forcing the second sample collection device into soil adjacent the drilling mechanism at a depth lower than the protective cover such that the sample collection device penetrates through the protective cover and into contact with the soil.

19. The method of claim 18, wherein the method further comprises obtaining a quantity of soil in the sample collection device and withdrawing the sample collection device while leaving the protective cover at least partially within the soil.

20. The method of claim 15, wherein the protective cover comprises an elongate sleeve having an open end and a closed end, and wherein the method comprises nesting the sample collection device within the protective cover such that the open end of the sample collection device is disposed adjacent the closed end of the protective cover.

21. A protective cover for selectively preventing the entry of soil and water into a soil sample collection device, the cover comprising:

an elongate sleeve having first and second ends, the second end being open, the sleeve having an inner diameter slightly larger than the soil sample collection device; and a cover member disposed at the first end so as to close the first end and selectively prevent the entry of soil into the sleeve and a soil sample collection device when disposed within the sleeve.

22. The protective cover of claim 21, wherein the cover member is puncturable by applying force to the soil sample collection device and driving said device into soil.

23. The protective cover of claim 21, wherein the sleeve is made of a water resistant material.

24. The protective cover of claim 21, wherein the sleeve comprises polypropylene.

25. The protective cover of claim 21, wherein the sleeve comprises polyethylene.

26. The protective cover of claim 21, wherein the sleeve is biodegradable.

* * * * *